US007352338B2

(12) United States Patent
Chenoweth

(10) Patent No.: US 7,352,338 B2
(45) Date of Patent: Apr. 1, 2008

(54) WIDEBAND ANTENNA WITH REDUCED DIELECTRIC LOSS

(75) Inventor: John P. Chenoweth, Coral Springs, FL (US)

(73) Assignee: Motorola, Inc., Schaumburg, IL (US)

( * ) Notice: Subject to any disclaimer, the term of this patent is extended or adjusted under 35 U.S.C. 154(b) by 574 days.

(21) Appl. No.: 10/896,274

(22) Filed: Jul. 21, 2004

(65) Prior Publication Data

US 2006/0030363 A1 Feb. 9, 2006

(51) Int. Cl.
*H01Q 1/36* (2006.01)

(52) U.S. Cl. ..... 343/897; 343/895

(58) Field of Classification Search ..... 343/897, 343/895

See application file for complete search history.

(56) References Cited

U.S. PATENT DOCUMENTS

| | | | | |
|---|---|---|---|---|
| 5,771,027 | A | 6/1998 | Marks et al. | |
| 6,043,792 | A * | 3/2000 | Finlayson | 343/867 |
| 6,741,221 | B2 | 5/2004 | Aisenbrey | |
| 6,774,849 | B2 * | 8/2004 | Umehara et al. | 343/700 MS |
| 2004/0174318 | A1 * | 9/2004 | Aisenbrey | 343/897 |

* cited by examiner

*Primary Examiner*—Hoang Nguyen
*Assistant Examiner*—Robert Karacsony

(57) ABSTRACT

A wideband antenna (10) includes a plurality of conductive strands (12) randomly interconnected and further coupled to a feedpoint (19) and a sheath (52) structurally retaining the plurality of conductive strands. The sheath can be a thin dielectric coating and the plurality of conductive strands can each be taller than one-quarter wavelength. The wideband antenna can have low dielectric losses while maintaining a multi-octave bandwidth. Air can be used as a dielectric between the plurality of conductive strands.

18 Claims, 2 Drawing Sheets

50

WIDEBAND ANTENNA WITH REDUCED DIELECTRIC LOSS

CROSS-REFERENCE TO RELATED APPLICATIONS

Not applicable

FIELD OF THE INVENTION

This invention relates generally to antennas, and more particularly to a wideband antenna without high dielectric losses.

BACKGROUND OF THE INVENTION

Wide band antenna response is often required to meet the demands of portable communication equipment which may use an 800 or 900 MHz carrier frequency, a GPS locator (which can operate at the GPS carrier frequencies in the L band in the frequency range between 1227.6 MHz and 1575.42 MHz), and may also talk with other devices over Bluetooth or WLAN frequencies which can range around 2.4 GHz. This multi-band requirement often leads to multiple antenna solutions with increased cost, increased complexity but lower reliability.

Most antennas used in wireless handset communications are wire whips, coils or sheets of metal such as planar inverted-F antennas (PIFA). These are relatively narrow band devices covering a range of about 10% of the bandwidth required. There is also a new class of related antennas known as conductive plastic antennas which attempt to generate the radiating fields within the plastic itself. The problem with the conductive plastic antennas is that the cheapest polymers or most commercially available plastics are themselves lossy and absorb much of the radiated energy especially at higher frequencies. An example of such an antenna including conductive plastic is discussed in U.S. Pat. No. 6,741,221 by Thomas A. Aisenbrey which describes "conductive loaded resin-based materials" used for the radiating antenna and the counterpoise antenna elements. No single existing antenna provides sufficient wideband performance while having minimal dielectric losses for the multi-band requirements of communication devices found today.

SUMMARY OF THE INVENTION

Embodiments in accordance with the present invention provides for a wideband antenna that utilizes a plurality of radiating elements that can generally use an air dielectric or an air dielectric with a thin dielectric coating. Such arrangement is immune to high dielectric losses associated with conductive plastic antennas while yet maintaining a multi-octave bandwidth.

In a first embodiment of the present invention, a wideband antenna includes a plurality of conductive strands randomly interconnected and further coupled to a feedpoint and a sheath structurally retaining the plurality of conductive strands. The sheath can be a thin dielectric coating and the plurality of conductive strands can each be taller than one-quarter wavelength. The wideband antenna can have low dielectric losses while maintaining a multi-octave bandwidth. Air can be used as a dielectric between the plurality of conductive strands, although embodiments in according to the invention are not necessarily limited thereto. Note, the feedpoint can be excited over a relatively larger ground plane.

In a second embodiment of the present invention, a radio transceiver unit can include a transmitter coupled to an encoder, a receiver coupled to a decoder, and a wideband antenna coupled to at least one among the transmitter and the receiver. The wideband antenna can include, wherein the wideband antenna comprises a plurality of conductive strands randomly interconnected and further coupled to a feedpoint and a sheath structurally retaining the plurality of conductive strands.

DETAILED DESCRIPTION OF THE DRAWINGS

Figure 1:
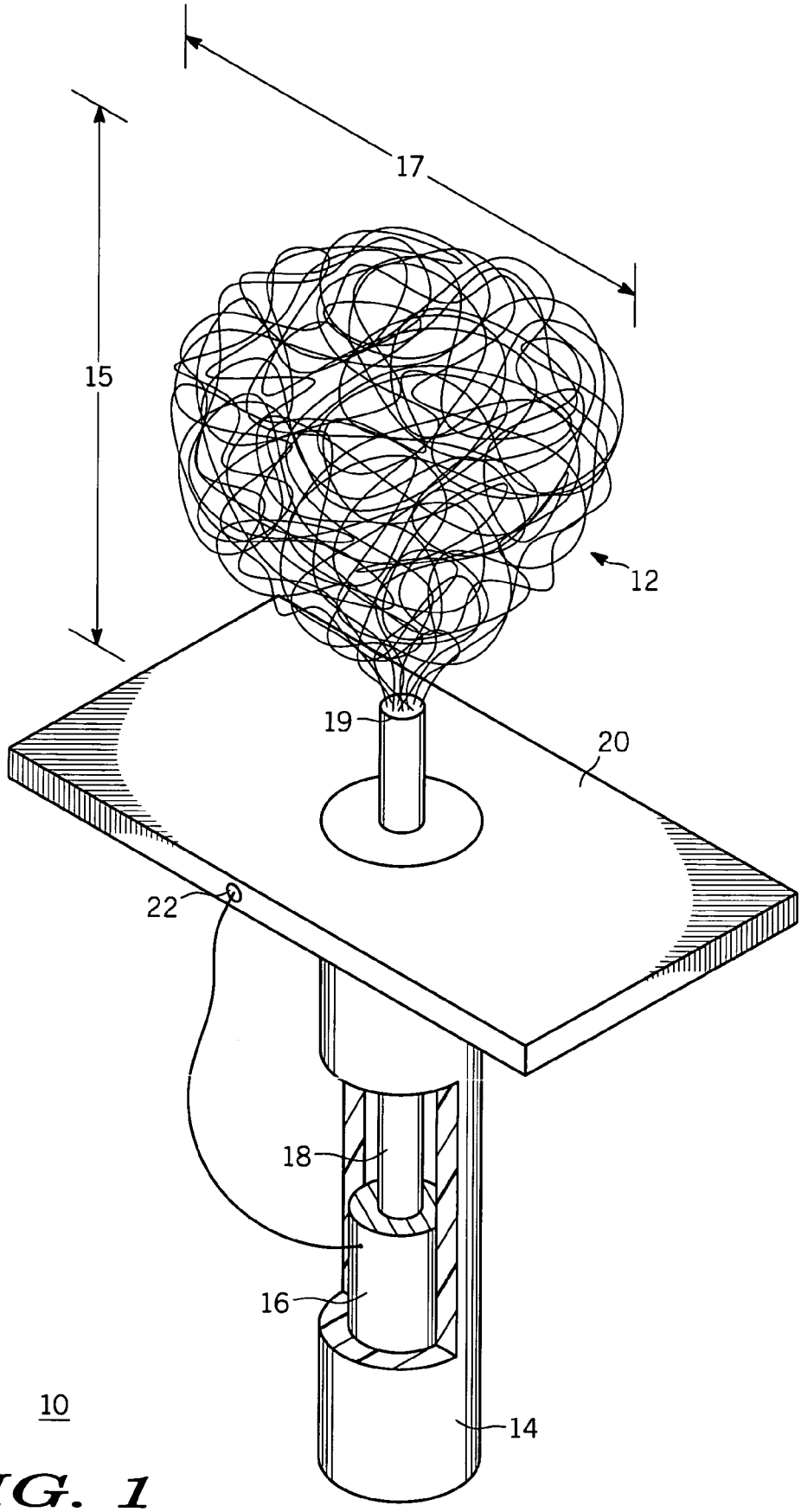
FIG. 1 is a schematic diagram of a wideband antenna having low dielectric losses in accordance with an embodiment of the present invention.

While the specification concludes with claims defining the features of embodiments of the invention that are regarded as novel, it is believed that the invention will be better understood from a consideration of the following description in conjunction with the figures, in which like reference numerals are carried forward.

Referring to FIG. 1, a plurality of conductive strands 12 such as a bundle of thin but electrically connected wires, similar to those found in a steel wool kitchen pad can produce a multi-octave response when connected as an antenna 10. The example illustrated can have a wideband resonance from 1155 MHz to 1946 MHz at a −8 dB return loss. This is equivalent to a bandwidth of almost 70% more or several times wider than the bandwidth found in common whips, helix, loop or metal plate antennas currently in use. Furthermore, embodiments in accordance with the invention can avoid the use of lossy dielectric material by using primarily air in-between wire strands and using a thin sheath 52 (as shown in FIG. 2) to add the necessary structural integrity.

Referring once again to the antenna 10 of FIG. 1, in construction, the antenna 10 can include the plurality of conductive strands 12 coupled or soldered to a single conductor feedpoint 19. The feedpoint 19 can be a part of a coaxial cable 14 for example having a shield 16 and a center conductor 18. The feedpoint 19 can be electrically connected to the center conductor 18. The shield 16 can be connected to ground via a metal insert 22 for example. The center conductor 18 can be fed through a ground plane 20 which should be relatively larger than the length 15 and width 17 of the radiating strands of the antenna (12) to ensure an approximate 50 ohm impedance match. For example, in one commonly used mobile antenna arrangement using a whip antenna (as in embodiments of the present invention using the plurality of conductive strands 12 collectively) should have a height approximately equal to a quarter wave length or 3¼ inches tall in the 800 MHz frequency band surrounded by a metallic ground plane about one quarter wavelength in diameter. In the commonly used mobile phone antenna arrangement, the quarter wavelength antenna sits on one side of a PCB whose approximate length is usually longer than the whip antenna itself. This arrangement guarantees that the impedance of the antenna is very close to 50 ohms. In such instances, the width of the conductive strands can determine the operating bandwidth.

In accordance with embodiments of the present invention using conductive strands as claimed, the operating bandwidth can be greater than that of a single radiator of equal diameter as found in a whip antenna.

Figure 2:
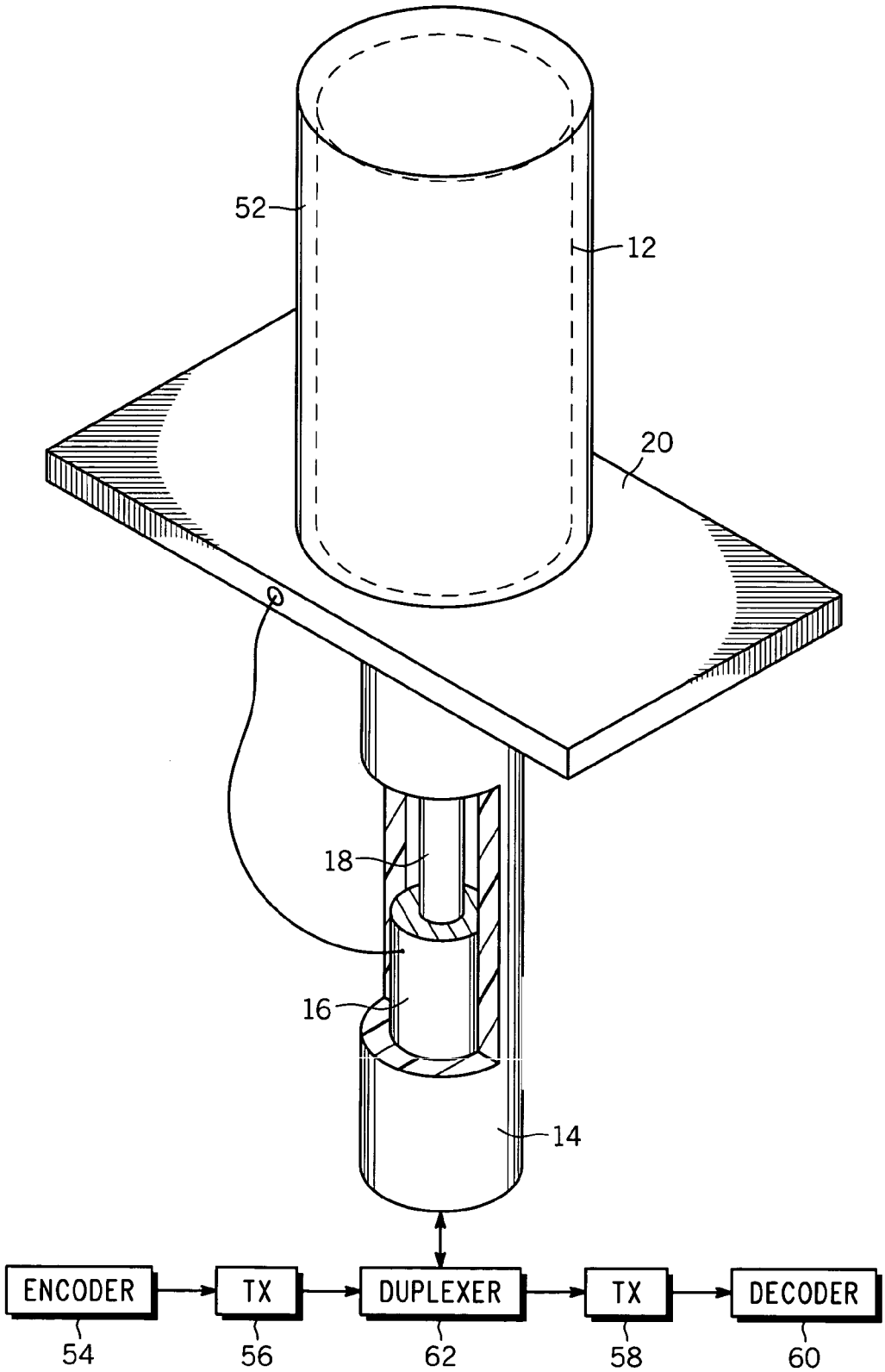
FIG. 2 is a schematic diagram of a radio system having a wideband antenna having low dielectric losses in accordance with an embodiment of the present invention

Referring to FIG. 2, a similarly constructed wideband antenna can form a portion of a transceiver unit 50. As before, the antenna can include the plurality of conductive strands 12 serving as the radiating element, the ground plane 20, and the coaxial cable 14 having the shield 16 coupled to the ground plane and the center conductor serving as the feedpoint. Additionally, the antenna herein further includes a means for structurally retaining the plurality of conductive strands. Such a means can include a sheath 52 made of a thin dielectric material. The transceiver unit 50 can further include a transmitter 56 coupled to an encoder 54, a receiver 58 coupled to a decoder 60, and means for coupling the wideband antenna to at least one among the transmitter and the receiver. The wideband antenna can be selectively coupled to the transmitter 56 or receiver 58 via a duplexer 62 for example. Of course, it should be noted that the use of the wideband antenna as disclosed herein is not limited to a transceiver, but can be used for receivers alone having multi-band requirements or for transmitters alone having multi-band requirements.

Embodiments in accordance with the present invention can eliminate most of the dielectric losses associated with previously disclosed conductive plastic antennas while improving the bandwidth of traditional whips and stubby antennas. The wideband antennas disclosed herein are capable of multi-octave bandwidth by using multiple, closely spaced conductive elements such as metallic strands with a low loss air dielectric in-between and further having a thin dielectric coating for structural integrity.

In light of the foregoing description, it should be recognized that embodiments in accordance with the present invention can be realized in numerous configurations contemplated to be within the scope and spirit of the claims. Additionally, the description above is intended by way of example only and is not intended to limit the present invention in any way, except as set forth in the following claims.

What is claimed is:

1. A wideband antenna, comprising:

a plurality of conductive strands randomly interconnected and further coupled to a feedpoint; and a sheath structurally retaining the plurality of conductive strands wherein air is primarily used as a dielectric between the plurality of conductive strands.

2. The wideband antenna of claim 1, wherein the sheath comprises a thin dielectric coating.

3. The wideband antenna of claim 1, wherein the wideband antenna has a multi-octave bandwidth.

4. The wideband antenna of claim 3, wherein the wideband antenna has low dielectric losses while maintaining the multi-octave bandwidth.

5. The wideband antenna of claim 1, wherein the plurality of conductive strands are each taller than one-quarter wavelength tall.

6. The wideband antenna of claim 1, wherein air is used as a dielectric between the plurality of conductive strands.

7. The wideband antenna of claim 1, wherein the feedpoint is excited over a relatively larger ground plane which is relative to a length and a width of the plurality of conductive strands collectively.

8. A radio transceiver unit, comprising:

a transmitter coupled to an encoder;

a receiver coupled to a decoder; and a wideband antenna coupled to at least one among the transmitter and the receiver, wherein the wideband antenna comprises:

a plurality of conductive strands randomly interconnected and further coupled to a feedpoint; and a sheath structurally retaining the plurality of conductive strands wherein air is primarily used as a dielectric between the plurality of conductive strands.

9. The radio transceiver unit of claim 8, wherein the sheath comprises a thin dielectric coating.

10. The radio transceiver unit of claim 8, wherein the wideband antenna has a multi-octave bandwidth.

11. The radio transceiver unit of claim 10, wherein the wideband antenna has low dielectric losses while maintaining the multi-octave bandwidth.

12. The radio transceiver unit of claim 8, wherein the plurality of conductive strands are each taller than one-quarter wavelength tall.

13. The radio transceiver unit of claim 8, wherein air is used as a dielectric between the plurality of conductive strands.

14. The radio transceiver unit of claim 8, wherein the feedpoint is excited over a relatively larger ground plane which is relative to a length and a width of the plurality of conductive strands collectively.

15. A wideband antenna, comprising:

means for randomly interconnecting a plurality of conductive strands and further coupling the plurality of conductive strands to a feedpoint; and means for structurally retaining the plurality of conductive strands wherein air is primarily used as a dielectric between the plurality of conductive strands.

16. The wideband antenna of claim 15, wherein the means for structurally retaining comprises a sheath having a thin dielectric coating.

17. The wideband antenna of claim 15, wherein the wideband antenna further comprises means for having a low dielectric loss over a multi-octave bandwidth.

18. The wideband antenna of claim 15, wherein the wideband antenna further comprises means for exciting the feedpoint over a relatively larger ground plane which is relative to a length and a width of the plurality of conductive strands collectively.

* * * * *